US007062207B2

(12) United States Patent
Tsuda et al.

(10) Patent No.: US 7,062,207 B2
(45) Date of Patent: Jun. 13, 2006

(54) POWDER TRANSPORT APPARATUS AND IMAGE FORMING APPARATUS THAT CAN STABILIZE REPLENISHMENT OF POWDER

(75) Inventors: Kiyonori Tsuda, Kanagawa (JP); Atsushi Sampe, Kanagawa (JP); Satoshi Hatori, Kanagawa (JP); Yuji Arai, Kanagawa (JP); Takeo Suda, Tokyo (JP); Tomoji Ishikawa, Kanagawa (JP); Naoto Watanabe, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 10/859,292

(22) Filed: Jun. 3, 2004

(65) Prior Publication Data

US 2004/0265011 A1 Dec. 30, 2004

(30) Foreign Application Priority Data

Jun. 30, 2003 (JP) ..... 2003-187407

(51) Int. Cl.
*G03G 15/08* (2006.01)

(52) U.S. Cl. ..... 399/260; 399/258

(58) Field of Classification Search ..... 399/260, 399/262, 252, 258, 120
See application file for complete search history.

(56) References Cited

U.S. PATENT DOCUMENTS

| | | | | |
|---|---|---|---|---|
| 4,969,015 A | | 11/1990 | Sanpe | |
| 5,109,254 A | | 4/1992 | Oka et al. | |
| 5,187,524 A | * | 2/1993 | Cherian | 399/258 |
| 5,235,384 A | | 8/1993 | Oka et al. | |
| 5,329,340 A | * | 7/1994 | Fukuchi et al. | 399/260 |
| 5,386,274 A | | 1/1995 | Sanpe et al. | |
| 5,416,568 A | | 5/1995 | Yoshiki et al. | |
| 5,532,795 A | | 7/1996 | Tatsumi et al. | |
| 5,552,877 A | | 9/1996 | Ishikawa et al. | |
| 5,565,973 A | | 10/1996 | Fujishiro et al. | |
| 5,589,919 A | * | 12/1996 | Ikunami et al. | 399/262 |
| 5,614,998 A | | 3/1997 | Sanpe | |
| 5,617,198 A | | 4/1997 | Ishikawa et al. | |
| 5,638,158 A | | 6/1997 | Sanpe et al. | |
| 5,638,160 A | * | 6/1997 | Vollenbroek | 399/258 |
| 5,646,721 A | | 7/1997 | Sugihara et al. | |
| 5,659,860 A | | 8/1997 | Sasaki et al. | |
| 5,663,788 A | | 9/1997 | Sanpe | |
| 5,671,470 A | | 9/1997 | Maruta et al. | |
| 5,678,125 A | | 10/1997 | Kutsuwada et al. | |
| 5,708,952 A | * | 1/1998 | Taniguchi et al. | 399/120 |

(Continued)

FOREIGN PATENT DOCUMENTS

JP 8-30097 2/1996

(Continued)

OTHER PUBLICATIONS

U.S. Appl. No. 07/911,078, filed Jul. 9, 1992, Ishikawa et al.

(Continued)

*Primary Examiner*—Arthur T. Grimley
*Assistant Examiner*—Laura K. Roth
(74) *Attorney, Agent, or Firm*—Oblon, Spivak, McClelland, Maier & Neustadt, P.C.

(57) ABSTRACT

In a powder transport apparatus, powder is transported through a pipe having a powder transport member that exerts a force on the powder such that the powder is moved downstream in a transport direction. A part regulating the amount of the powder to be transported is provided in the pipe.

24 Claims, 6 Drawing Sheets

U.S. PATENT DOCUMENTS 5,758,235 A 5/1998 Kosuge et al.
5,758,241 A 5/1998 Oyama et al.
5,761,576 A 6/1998 Sugihara et al.
5,765,059 A 6/1998 Kosuge et al.
5,768,664 A 6/1998 Kosuge et al.
5,771,426 A 6/1998 Oka et al.
5,771,429 A 6/1998 Oyama et al.
5,784,669 A 7/1998 Miura et al.
5,787,328 A 7/1998 Sugihara et al.
5,805,965 A 9/1998 Tsuda et al.
5,815,767 A 9/1998 Kutsuwada et al.
5,822,664 A 10/1998 Oka et al.
5,826,146 A 10/1998 Maruta et al.
5,850,586 A 12/1998 Sugihara et al.
5,887,224 A 3/1999 Mizuishi et al.
5,913,092 A 6/1999 Bisaiji et al.
5,915,143 A 6/1999 Watanabe et al.
5,915,155 A 6/1999 Shoji et al.
5,915,156 A 6/1999 Kizaki et al.
5,940,664 A 8/1999 Sugihara et al.
5,956,549 A 9/1999 Sugihara et al.
5,991,569 A 11/1999 Sugihara et al.
5,999,772 A 12/1999 Kakitani et al.
6,006,050 A 12/1999 Watanabe et al.
6,026,255 A 2/2000 Kizaki et al.
6,055,388 A 4/2000 Watanabe et al.
6,055,394 A 4/2000 Suda et al.
6,070,037 A 5/2000 Sugihara et al.
6,072,967 A 6/2000 Sugihara et al.
6,097,914 A 8/2000 Tanaka et al.
6,101,351 A 8/2000 Suda et al.
6,104,900 A 8/2000 Ishikawa et al.
6,122,469 A 9/2000 Miura et al.
6,125,243 A 9/2000 Shoji et al.
6,141,520 A 10/2000 Kosuge
6,198,895 B1 3/2001 Tsuda et al.
6,198,985 B1 3/2001 Miyasaka et al.
6,256,459 B1 7/2001 Hasegawa et al.
6,256,465 B1 7/2001 Yoshinaga et al.
6,336,013 B1 1/2002 Suda et al.
6,336,020 B1 1/2002 Ishikawa et al.
6,337,957 B1 1/2002 Tamaki et al.
6,463,237 B1 10/2002 Suda et al.
6,522,855 B1 2/2003 Katoh et al.
6,560,414 B1 5/2003 Suda et al.
6,597,881 B1 7/2003 Hatori et al.
6,601,991 B1 8/2003 Sampe
6,615,013 B1 9/2003 Arai et al.
6,763,208 B1 7/2004 Nagatsuna et al.
6,768,881 B1 7/2004 Hatori
6,798,996 B1 9/2004 Sawada et al.
6,807,390 B1 10/2004 Suda et al.
6,829,461 B1 12/2004 Arai et al.
6,856,774 B1 2/2005 Sampe et al.
6,873,814 B1 3/2005 Ohjimi et al.
6,885,836 B1 4/2005 Kimura et al.
6,889,023 B1 5/2005 Suda et al.
6,895,209 B1 5/2005 Kawahara et al.
6,934,493 B1 * 8/2005 Murakami ..... 399/258
6,937,838 B1 8/2005 Ishii et al.
6,941,090 B1 9/2005 Uchida et al.
6,975,830 B1 12/2005 Murakami et al.
2003/0180071 A1 9/2003 Suda
2004/0013442 A1 1/2004 Suzuki et al.
2004/0042822 A1 3/2004 Fujishiro et al.
2004/0096239 A1 5/2004 Hosokawa et al.
2004/0101328 A1 5/2004 Kimura et al.
2004/0131381 A1 7/2004 Kawasumi et al.
2004/0265011 A1 12/2004 Tsuda et al.
2005/0169663 A1 8/2005 Shintani et al.
2005/0196194 A1 9/2005 Suda et al.
2005/0232666 A1 10/2005 Ojimi et al.
2005/0249533 A1 11/2005 Suda et al.

FOREIGN PATENT DOCUMENTS

JP 10-239974 9/1998

OTHER PUBLICATIONS

U.S. Appl. No. 08/459,423, filed Jun. 2, 1995.
U.S. Appl. No. 09/148,509, filed Sep. 4, 1998, Kakitani et al.
U.S. Appl. No. 10/612,146, filed Jul. 3, 2003, Miura et al.
U.S. Appl. No. 11/182,863, filed Jul. 18, 2005, Hosokawa et al.
U.S. Appl. No. 11/203,964, filed Aug. 16, 2005, Taguchi et al.
U.S. Appl. No. 11/220,845, filed Sep. 8, 2005, Tsuda et al.
U.S. Appl. No. 11/247,269, filed Oct. 12, 2005, Uchiyama et al.
U.S. Appl. No. 11/226,197, filed Sep. 15, 2005, Kimura et al.
U.S. Appl. No. 11/269,717, filed Nov. 9, 2005, Fujimori et al.

* cited by examiner

POWDER TRANSPORT APPARATUS AND IMAGE FORMING APPARATUS THAT CAN STABILIZE REPLENISHMENT OF POWDER

BACKGROUND OF THE INVENTION

1. Field of the Invention

The present invention relates to a powder transport apparatus that transports powder such as toner from a powder container to a transport destination located lower than the powder container via a powder transport tube, and to an image forming apparatus including the powder transport apparatus.

2. Description of the Related Art

Conventionally, image forming apparatuses such as copying machines, facsimile machines, and printing machines are known that use a toner feeding apparatus. The toner feeding apparatus includes, for example, toner providing means for providing toner from a toner container and a feeding tube connecting a developing part and the toner container. The developing part develops a latent image carried on a latent image carrier such as a photo conductor into a toner image. The toner providing means are operated in accordance with need so as to provide toner contained in the toner container into the feeding tube, and the toner is directly fed into the developing part via the feeding tube.

Assuming that the toner container is arranged at a position lower than the developing part in an image forming apparatus using such a toner feeding apparatus, it is necessary to feed the toner provided from the toner container into the feeding tube to flow upward to the developing part against gravity. Hence, feeding efficiency may be decreased, or the feeding tube is likely to be blocked by the toner.

Accordingly, generally, the toner container is arranged at a position higher than the developing part so as to feed the toner in the gravity direction. Toner feeding apparatuses that perform feeding in the gravity direction in the aforementioned manner include, for example, a toner feeding apparatus described in Japanese Laid-Open Patent Application No. 8-30097. In the toner feeding apparatus, toner provided from a toner box, which is the toner container, into the feeding tube is fed into the developing part by making the toner fall by its own weight.

In the toner feeding apparatus, however, there is a probability that the toner will flow into the developing part at a blast (sudden rapid rate) when the toner disposed on an inside wall of the feeding tube reaches a certain large amount (builds up). When the toner flows into the developing part at a blast as mentioned above, in a binary developer method that uses a binary developer including toner and a magnetic carrier, for example, it is difficult to control the toner concentration of the binary developer. Additionally, in a single-component developing method that uses only toner without using a magnetic carrier, for example, the ratio of the toner that is not sufficiently friction-charged within the developing part rapidly increases, and so-called scumming, which causes the toner to adhere to a non-image portion of a latent image carrier, is likely to occur. It is possible to make the length of the feeding tube short by arranging the toner box and the developing part close to each other so as to prevent the toner from being built up within the feeding tube. However, flexibility in layout in the image forming apparatus is decreased due to the restriction of such a close arrangement of the toner box and the developing part.

Therefore, it is conceivable to provide in the feeding pipe means for applying a feeding force to the toner, for example, a coil. By applying the feeding force to the toner, it is possible to prevent the toner from accumulating within the feeding tube and prevent the accumulated toner from flowing into the developing part at a blast.

In a case where such a structure is adopted, however, the cross-sectional area of the coil is small with respect to that of the space inside the feeding tube. Thus, in the cross-sectional area of the feeding tube, those portions that are not filled with the cross-sectional area of the coil serve as spaces that allow the toner to pass therethrough. Hence, when a large amount of the toner is provided at a blast from the toner container, the toner flows through the spaces, i.e., the toner flows into the developing part irrespective of rotation of the coil. Accordingly, there is a possibility that replenishment control of the toner with respect to the developing part may be unstable.

A description is given above regarding the problems that may occur in the toner feeding apparatuses that feed toners as powders. However, also in other powder feeding apparatuses that feed powders that are different from toners, there is a possibility that some problems may occur when replenishment control of powders flowing from inside the feeding tube to a feeding destination becomes unstable.

SUMMARY OF THE INVENTION

A general object of the present invention is to provide an improved and useful powder feeding apparatus and an image forming apparatus having a powder feeding apparatus in which one or more of the above-mentioned problems are eliminated.

Another and more specific object of the present invention is to provide: a powder feeding apparatus that does not deleteriously affect the layout of other apparatuses and can stabilize replenishment of powder; and an image forming apparatus having such a powder feeding apparatus.

In order to achieve the above-mentioned objects, according to one aspect of the present invention, there is provided a powder transport apparatus including:

a powder container containing powder;

a powder transport pipe through which the powder is transported from the powder container to a transport destination located below the powder container;

a powder transport member that is provided in the powder transport pipe and exerts, when the powder transport member is moved, a force on the powder such that the powder is moved downstream in a transport direction along which the powder is to be transported; and a part that regulates the amount of the powder transported through the powder transport pipe, the part being provided in the powder transport pipe.

According to the present invention, the powder transport member provided in the powder transport tube that transports the powder from the powder container to the transport destination exerts a force on the powder in the powder transport tube such that the powder is moved in the transport direction. Accordingly, different from powder transport apparatuses that transport powder by causing the powder to fall with its own weight, it is possible to prevent powder from accumulating in the powder transport tube. Since it is possible to prevent accumulation of powder in the powder transport tube by using the powder transport member in the aforementioned manner, it is unnecessary to arrange the powder container in the vicinity of the transport destination for prevention of powder accumulation. Also, it is possible to adopt a layout in which the distance between the powder container and the transport destination is increased.

Further, the part (a member regulating the transport amount of powder) provided in the powder transport tube controls the downstream movement in the transport direction of the powder that exceeds a desired transport amount and is moving downstream in the transport direction. Hence, the powder that exceeds the desired transport amount is not transported downstream beyond the above-mentioned part, and the powder of the transport amount corresponding to the movement of the powder transport member, i.e., the powder of the desired transport amount, is transported. Accordingly, it is possible to stabilize the amount of powder transported to the transport destination.

When powder is transported in the aforementioned manner, even if the length of the powder transport tube is relatively increased, it is possible to prevent problems such as accumulation of powder in the powder transport tube and instability of the amount of powder transported to the transport destination. Hence, it is possible to adopt a layout in which the distance between the powder container and the transport destination is long. Also, it is possible to adopt a layout in which the layouts of other apparatuses are considered.

According to the present invention, restrictions in the layout of a powder transport apparatus are decreased, and it is possible to increase flexibility in the layouts of other apparatuses. Simultaneously, it is possible to stabilize the transportation amount of powder.

Additionally, according to another aspect of the present invention, there is provided a toner container configured to be used in an image forming apparatus including:

a toner image forming part forming a toner image by using toner; and a toner transport apparatus transporting the toner from a toner container to the toner image forming part, the toner transport apparatus including:

the toner container containing the toner;

a toner transport pipe through which the toner is transported from the toner container to a transport destination located below the toner container;

a toner transport member that is provided in the toner transport pipe and exerts, when the toner transport member is moved, a force on the toner such that the toner is moved downstream in a transport direction along which the toner is to be transported; and a part that regulates the amount of the powder transported through the powder transport pipe, the part being provided in the powder transport pipe, wherein the toner image forming part is an image forming unit including a latent image carrier carrying a latent image thereon and a developing part developing the latent image on the latent image carrier, the image forming unit is attachable to and detachable from the image forming apparatus, and the toner container is attachable to and detachable from the image forming apparatus separately from the image forming unit.

Additionally, according to another aspect of the present invention, there is provided a process cartridge configured to be used in an image forming apparatus including:

a toner image forming part forming a toner image by using toner; and a toner transport apparatus transporting the toner from a toner container to the toner image forming part, the toner transport apparatus including:

the toner container containing the toner;

a toner transport pipe through which the toner is transported from the toner container to a transport destination located below the toner container;

a toner transport member that is provided in the toner transport pipe and exerts, when the toner transport member is moved, a force on the toner such that the toner is moved downstream in a transport direction along which the toner is to be transported; and a part that regulates the amount of the powder transported through the powder transport pipe, the part being provided in the powder transport pipe, wherein the toner image forming part is an image forming unit including: an image carrier carrying an electrostatic latent image thereon; a charging unit charging the image carrier; a developing unit developing the electrostatic latent image on the image carrier into a toner image by carrying a developer on a developer carrier and transporting the developer to a developing region facing the image carrier; and a cleaning unit removing residual toner remaining on the image carrier after the developed toner image is transferred to a transfer medium, the image forming unit is attachable to and detachable from the image forming apparatus, the toner container is attachable to and detachable from the image forming apparatus separately from the image forming unit, the process cartridge integrally supporting one or more units selected from the group consisting of the image carrier, the developing unit, the charging unit, and the cleaning unit, the units including at least the developing unit, the process cartridge is attachable to and detachable from the image forming apparatus.

Accordingly, flexibility in layout in the image forming apparatus is improved, and it is possible to adopt an arrangement suitable for an image forming apparatus having a reduced size.

Other objects, features and advantages of the present invention will become more apparent from the following detailed description when read in conjunction with the following drawings.

DETAILED DESCRIPTION OF THE PREFERRED EMBODIMENTS

A description is given below of an electrophotographic printer (hereinafter simply referred to as "printer") 100 as an example of an image forming apparatus to which one embodiment of the present invention is applied.

First, a description is given of a basic structure of the printer 100.

Figure 1:
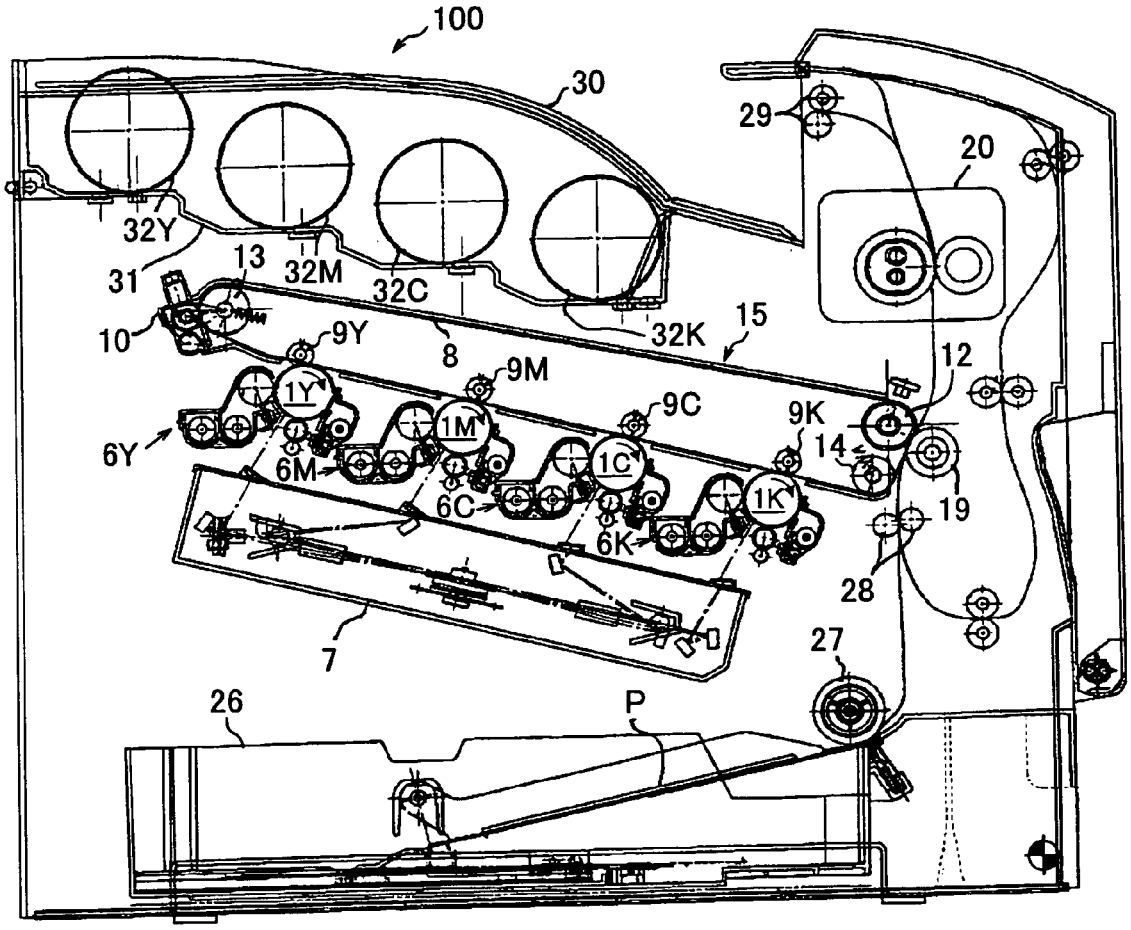
FIG. 1 is a schematic diagram of a printer according to one embodiment of the present invention.
Figure 2:
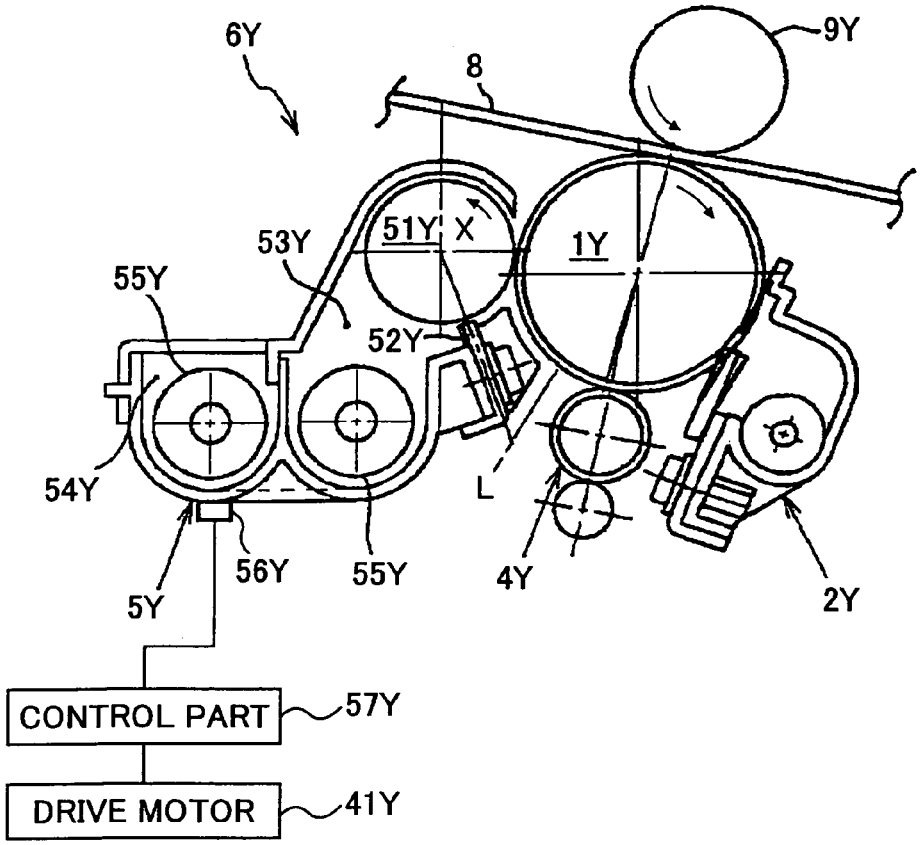
FIG. 2 is an enlarged schematic diagram showing a Y process cartridge of the printer shown in FIG. 1 and the periphery of the Y process cartridge.

FIG. 1 is a schematic diagram showing a structure of the printer 100. In FIG. 1, the printer 100 includes four process cartridges 6Y, 6M, 6C and 6K for generating toner images of yellow, magenta, cyan, and black (hereinafter referred to as "Y", "M", "C" and "K"), respectively. The process cartridges 6Y, 6M, 6C and 6K have the same structure except that they use Y toner, M toner, C toner and K toner, having different colors, respectively, as image forming materials. The process cartridges 6Y, 6M, 6C and 6K are replaced when they come to the ends of their service lives. Taking the process cartridge 6Y for generating the Y toner image as an example, as shown in FIG. 2, the process cartridge 6Y includes: a drum photo conductor 1Y; a drum cleaning apparatus 2Y; a neutralization apparatus (not shown); a charging apparatus 4Y; and a developing apparatus 5Y, for example. The process cartridge 6Y may be attached to and detached from the printer 100, and consumable parts may be replaced all at once.

As mentioned above, each of the four process cartridges 6Y, 6M, 6C and 6K includes: the photo conductor; the drum cleaning apparatus; the neutralization apparatus; the charging apparatus; and the developing apparatus (the reference numerals thereof are omitted), and these components may be integrally attached to and detached from the printer 100 all at once. Conventionally, each of the above-mentioned components such as the photo conductor is provided as a consumable part that can be separately attached to and detached from the printer 100, and is replaced in accordance with need. However, since it is difficult for an operator to understand attaching/detaching operations of each of the components, maintainability is degraded.

Therefore, a printer has been developed that employs a process cartridge system in which the components such as the photo conductor are replaced all at once so as to improve maintainability, and also employs a system in which it is assumed that a cartridge reaches the end of its service life when toner in the developing apparatus runs out. However, with such a structure, since it is necessary to replace those components not yet reaching the ends of their own service lives (those components that are still serviceable) at the time when the toner runs out, there is a disadvantage in that the wasted components are increased.

On the other hand, an image forming apparatus is known in which a toner container that contains toner to be supplied to the developing apparatus of a process cartridge is configured to be attachable and detachable with respect to the process cartridge (for example, the image forming apparatus described in Japanese Laid-Open Patent Application No. 10-239974).

With such a configuration, however, even if only the toner container should be replaced, the process cartridge must be detached from the main body of the image forming apparatus. Thus, there is a disadvantage in that it is inconvenient to replace the toner container.

In the printer 100, the above-mentioned disadvantages are eliminated by configuring the process cartridges 6Y, 6M, 6C and 6K and toner bottles 32Y, 32M, 32C and 32K to be attachable and detachable with respect to the printer 100.

The charging apparatus 4Y uniformly charges the surface of the photo conductor 1Y rotated clockwise by driving means (not shown). The uniformly charged surface of the photo conductor 1Y is scanned by means of a laser beam L and carries a Y electrostatic latent image thereon. The Y electrostatic latent image is developed into a Y toner image by means of the developing apparatus 5Y that uses the Y toner, and then transferred onto an intermediate transfer belt 8. The drum cleaning apparatus 2Y removes the residual Y toner on the surface of the photo conductor 1Y subjected to the intermediate transfer process. The neutralization apparatus neutralizes residual charges on the photo conductor 1Y subjected to the cleaning. The neutralization process initializes the surface of the photo conductor 1Y so as to prepare for the subsequent image formation. Similarly, in the other process cartridges 6M, 6C and 6K, an M toner image, a C toner image and a K toner image are formed on photo conductors 1M, 1C and 1K, respectively, and transferred onto the intermediate transfer belt 8.

In FIG. 1, an exposure apparatus 7 is arranged underneath the process cartridges 6Y, 6M, 6C and 6K. The exposure apparatus 7, which serves as latent image forming means, directs the laser beams L emitted based on image information to photo conductors 1Y, 1M, 1C and 1K of the process cartridges 6Y, 6M, 6C and 6K, respectively, and performs exposure. With the exposure, Y, M, C and K electrostatic latent images are formed on the photo conductors 1Y, 1M, 1C and 1K. It should be noted that the exposure apparatus 7 directs the laser beams L emitted from light sources to the photo conductors 1Y, 1M, 1C and 1K via a plurality of optical lenses and mirrors while scanning the laser beams L by means of a polygon mirror that is driven and rotated by a motor.

Paper feeding means including: a paper-containing cassette 26; a paper feed roller 27 mounted on the paper-containing cassette 26; and a pair of resist rollers 28, for example, are arranged underneath the exposure apparatus 7. The paper-containing cassette 26 contains a plurality of sheets of transfer papers P, which serve as recording media, in an overlapping manner. The paper feed roller 27 contacts the uppermost sheet of transfer paper P. When the paper feed roller 27 is rotated counterclockwise in FIG. 1 by driving means (not shown), the uppermost sheet of transfer paper P is fed toward between the pair of resist rollers 28. The resist rollers 28 are driven and rotated so as to interpose the sheet of transfer paper P therebetween. However, the rotation of the resist rollers 28 is temporarily stopped immediately after the sheet of transfer paper P is interposed between the resist rollers 28. Then, the resist rollers 28 feed the sheet of transfer paper P toward a secondary transfer nip (which is described later) at a suitable timing. In the paper feeding means having the above-mentioned structure, the combination of the paper feed roller 27 and the pair of resist rollers 28, which serve as timing rollers, form transport means. The transport means transports sheets of transfer paper P from the paper-containing cassette 26, which serves as containing means, to the secondary transfer nip that is described later.

An intermediate transfer unit 15 is arranged above the process cartridges 6Y, 6M, 6C and 6K. The intermediate transfer belt 8 is stretched around the intermediate transfer unit 15, and the intermediate transfer unit 15 moves the intermediate transfer belt 8. In addition to the intermediate belt 8, the intermediate transfer unit 15 includes, for example, four primary transfer bias rollers 9Y, 9M, 9C and 9D and a cleaning apparatus 10. Further, the intermediate transfer unit 15 includes a secondary transfer backup roller 12, a cleaning backup roller 13, and a tension roller 14. The intermediate transfer belt 8 is endlessly moved counter-clockwise in FIG. 1 by rotation of at least one of the three rollers (12, 13 and 14) while being stretched by the three rollers (12, 13 and 14). Primary transfer bias rollers 9Y, 9M, 9C and 9K and the photo conductors 1Y, 1M, 1C and 1K interpose therebetween the intermediate transfer belt 8 that is endlessly moved in the aforementioned manner, thereby forming the primary transfer nips. The primary transfer bias rollers 9Y, 9M, 9C and 9K apply to the back surface of the intermediate transfer belt 8 (inner side surface of the loop formed by the intermediate transfer belt 8) transfer bias having the polarity (e.g., positive) opposite to that of the toners. All of the rollers other than the primary transfer bias rollers 9Y, 9M, 9C and 9K are electrically grounded. The Y, M, C and K toner images on the photo conductors 1Y, 1M, 1C and 1K, respectively, are transferred onto the intermediate transfer belt 8 in a superposing manner, as the intermediate transfer belt 8 sequentially passes through the Y. M, C and K primary transfer nips with its endless movement. Consequently, a four-color superposed toner image (hereinafter referred to as "four-color toner image") is formed on the intermediate transfer belt 8.

The secondary transfer backup roller 12 and the secondary transfer roller 19 interpose therebetween the intermediate transfer belt 8, thereby forming the secondary transfer nip. The four-color toner image formed on the intermediate transfer belt 8 is transferred to a sheet of the transfer paper P by means of the secondary transfer nip. Transfer residual toner that is not transferred onto the sheet of the transfer paper P adheres to the portion of the intermediate transfer belt 8 that passes through the secondary transfer nip. Such transfer residual toner is removed by means of the cleaning apparatus 10.

In the secondary transfer nip, a sheet of the transfer paper P is transported in the direction opposite to the resist rollers 28 while being interposed between the intermediate transfer belt 8 and the secondary transfer roller 19, each of which is moving in the forward direction. The four-color toner image transferred onto the surface of the sheet of the transfer paper P that is delivered from the secondary transfer nip is fixed thereon by heat and pressure at the time the sheet of the transfer paper P passes through between rollers of a fixing apparatus 20. Then, the sheet of the transfer paper P is delivered outside the printer 100 by passing through between a pair of delivering rollers 29. A stack portion 30 is formed on a top surface of the printer 100. Those sheets of the transfer paper P delivered outside the printer 100 by means of the delivering rollers 29 are sequentially stacked on the stack portion 30.

A description is given below of the developing apparatus 5Y of the process cartridge 6Y.

The developing apparatus 5Y includes magnetic field generating means therein and also includes a developing sleeve 51Y and a doctor 52Y. The developing sleeve 51Y serves as a developer carrier and transports a binary developer including magnetic particles and toner by carrying the binary developer on a surface thereof. The doctor 52Y serves as a developer regulating member that regulates the thickness of the developer carried on and transported by the developing sleeve 51Y. A developer container 53Y is provided in the upstream side of the developer transport direction of the doctor 52Y. The developer container 53Y contains the developer that is regulated by the doctor 52Y and not transported to a developing region facing the photo conductor 1Y. Further, the developing apparatus 5Y includes: a toner container 54Y that contains toner and is provided adjacent to the developer container 53Y; and a toner transport screw 55Y for agitating and transporting the toner.

A description is given below of operations of the developing apparatus 5Y.

In the developing apparatus 5Y, a developer layer is formed on the developing sleeve S1Y. In addition, with the movement of the developer layer transported by rotation of the developer sleeve S1Y, the toner is mixed into the developer from the developer container 53Y. The toner mixing is performed such that the toner concentration of the developer falls within a predetermined range. The toner incorporated into the developer is charged by friction charging with carriers. The developer including the charged toner is supplied to the surface of the developing sleeve 51Y having a magnetic pole therein, and carried on the surface of the developing sleeve S1Y by magnetic force. The developer layer carried on the developing sleeve S1Y is transported in the direction indicated by an arrow X in FIG. 2 with the rotation of the developing sleeve S1Y. In the middle of the rotation, the thickness of the developer layer is regulated by the doctor 52Y. Thereafter, the developer layer is transported to the developing region facing the photo conductor 1Y. In the developing region, image development is performed based on a latent image formed on the photo conductor 1Y. The developer layer remaining on the developing sleeve S1Y is transported to the upstream portion in the developer transport direction of the developer container 53Y as the developing sleeve S1Y is rotated.

Referring again to FIG. 1, a bottle container 31 is arranged between the intermediate transfer unit 15 and the stack portion 30 provided above the intermediate transfer unit 15. The bottle container 31 contains toner bottles 32Y, 32M, 32C and 32K having therein the Y, M, C and K toners, respectively. The toner bottles 32Y, 32M, 32C and 32K are located in the bottle container 31 such that the toner bottles 32Y, 32M, 32C and 32K are arranged from top to bottom in this order. The Y, M, C and K toners in the toner bottles 32Y, 32M, 32C and 32K are suitably supplied to developing apparatuses of the process cartridges 6Y, 6M, 6C and 6K, respectively. The toner bottles 32Y, 32M, 32C and 32K may be independently attached to and detached from the process cartridges 6Y, 6M, 6C and 6K, respectively.

Figure 3:
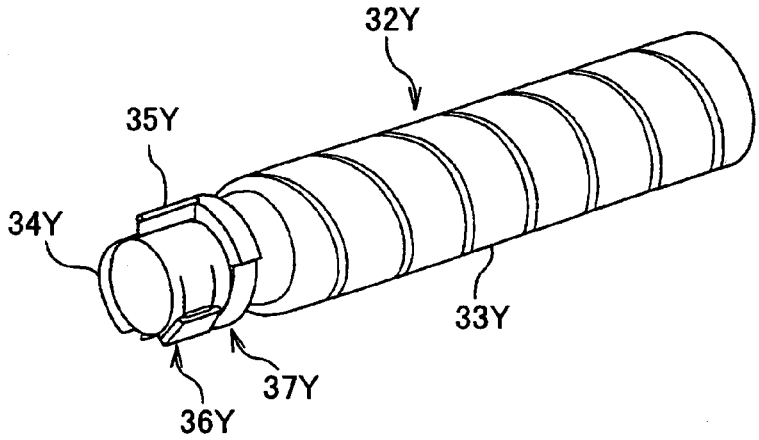
FIG. 3 is a perspective view of a Y toner bottle of the printer shown in FIG. 1.
Figure 4:
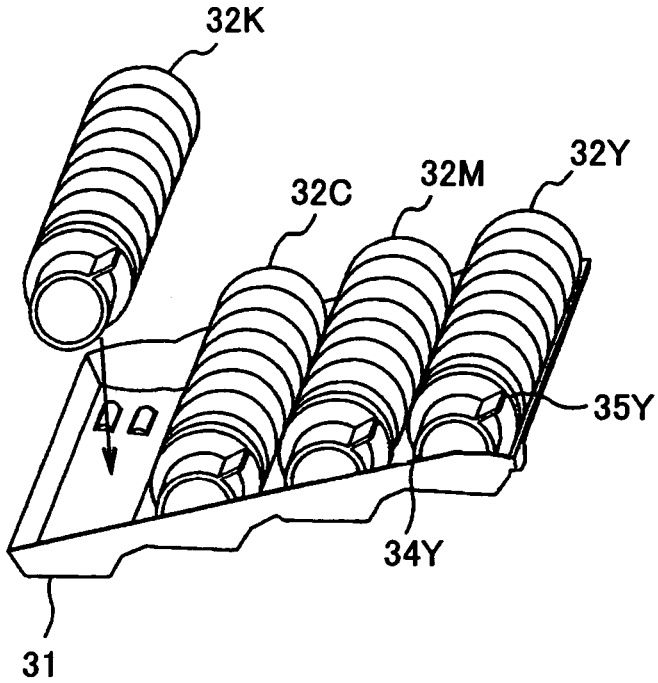
FIG. 4 is a perspective view of a bottle container and four toner bottles of the printer shown in FIG. 1.

FIG. 3 is a perspective view of the toner bottle 32Y. FIG. 4 is a perspective view of the toner bottle 32K to be located in the bottle container 31 (FIG. 1). As shown in FIG. 3, the toner bottle 32Y is provided with a resin case 34Y in an end portion of a bottle body 33Y. A handle 35Y is integrally formed with the resin case 34Y. In addition, the bottle body 33Y is provided with a gear 37Y near the resin case 34Y. The gear 37Y is integrally rotated with the bottle body 33Y.

When attaching the toner bottle 32Y to the printer 100, first, the stack portion 30 is opened upward so that the bottle container 31 is exposed. Then, as shown in FIG. 4, after placing the toner bottle 32Y on the bottle container 31, the handle 35Y is rotated. As a result, the resin case 34Y, which is integrally formed with the handle 35Y, is rotated, a shutter 36Y (FIG. 3) is moved and opened in the circumferential direction of the resin case 34Y, and a toner-providing opening (not shown) is opened. Simultaneously, the resin case 34Y and the bottle container 31 are connected and fixed to each other.

On the other hand, when detaching the toner bottle 32Y from the printer 100, by rotating the handle 35Y in the reverse direction, the connection between the resin case 34Y and the bottle container 31 is canceled. Simultaneously, the shutter 36Y is closed and the toner-providing opening is closed. It is possible to remove the toner bottle 32Y from the printer 100 by keeping on gripping the handle 35Y.

In the aforementioned manner, it is possible to place the toner bottle 32Y from above the printer 100 and perform attachment and detachment of the toner bottle 32Y. Thus, it is easy to understand and perform the replacement operation of the toner bottle 32Y. Additionally, since the handle 35Y is formed on the resin case 34Y, it is possible to easily fix the resin case 34Y to the bottle container 31 by rotating the resin case 34Y. It should be noted that, in a state where the toner bottle 32Y is detached from the printer 100, the shutter 36Y is not opened even if the handle 35Y of the resin case 34Y is rotated. Hence, it is possible to prevent the shutter 36Y from being erroneously opened and prevent the toner inside the toner bottle 32Y from spilling out at the time of the replacement operation of the toner bottle 32Y.

A description is given of toner transport means.

Figure 5:
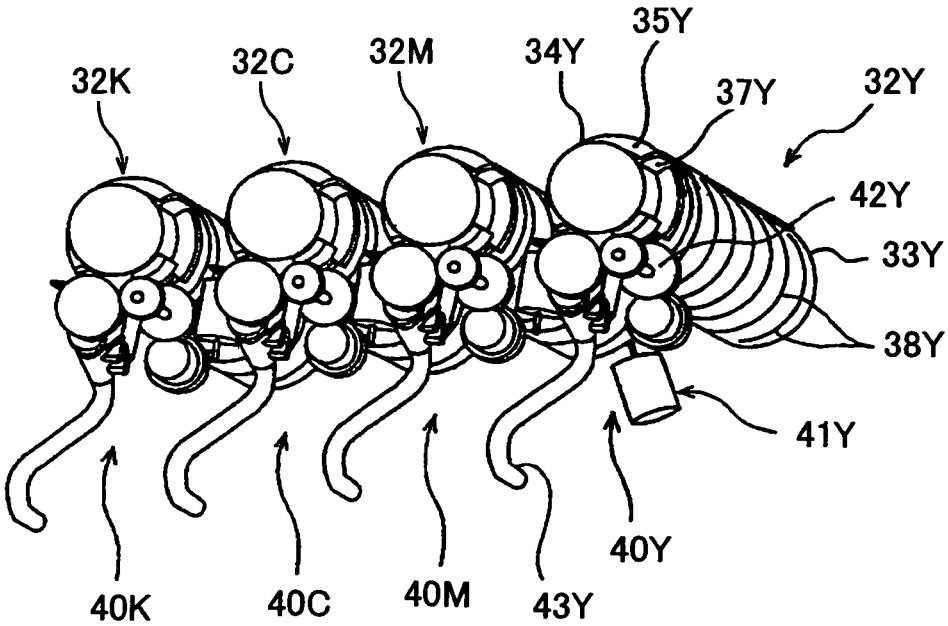
FIG. 5 is a perspective view of a part of Y, M C and K toner transport apparatuses of the printer shown in FIG. 1.
Figure 6:
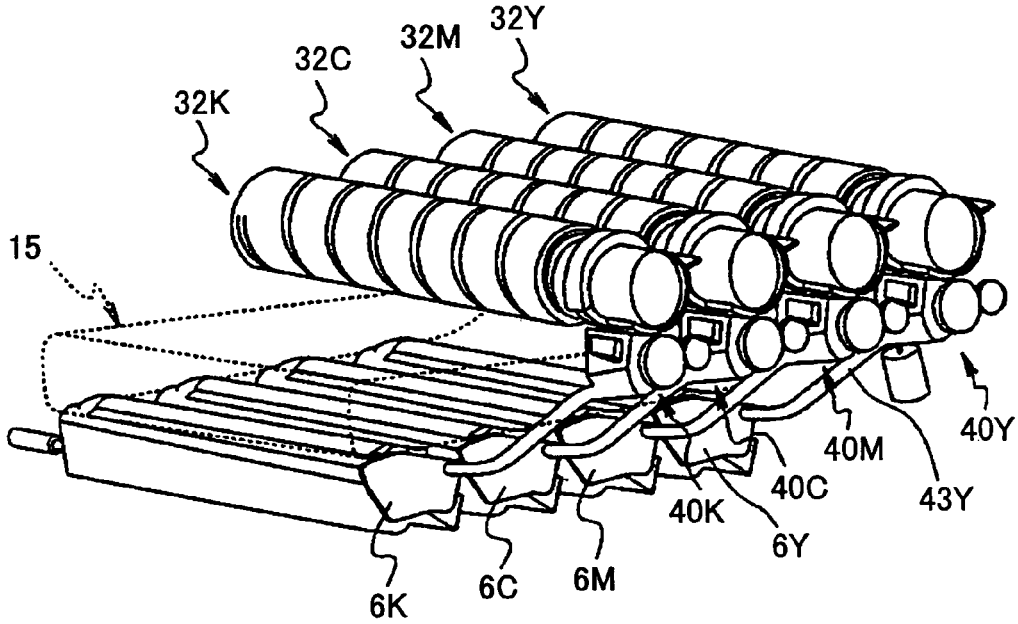
FIG. 6 is a perspective view of a part of the Y, M C and K toner transport apparatuses and Y, M, C and K process cartridges of the printer shown in FIG. 1.

FIG. 5 is a perspective view of the toner bottles 32Y, 32M, 32C and 32K and toner transport apparatuses 40Y, 40M, 40C and 40K. FIG. 6 is a perspective view of the toner bottles 32Y, 32M, 32C and 32K, the intermediate transfer unit 15, and the toner transport apparatuses 40Y, 40M, 40C and 40K, seen from an angle different from that of FIG. 5.

The toner transport apparatuses 40Y, 40M, 40C and 40K are provided in the printer 100 at the side of the intermediate transfer unit 15. Thus, since it is unnecessary to provide toner transport means to the process cartridges 6Y, 6M, 6C and 6K or the toner bottles 32Y, 32M, 32C and 32K, it is possible to reduce the sizes of the process cartridges 6Y, 6M, 6C and 6K or the toner bottles. 32Y, 32M, 32C and 32K, compared to conventional process cartridges or toner bottles. In addition, conventionally, there has been a design limitation since process cartridges and toner bottles are located in close vicinity. However, in this embodiment, it is possible to arrange the process cartridges 6Y, 6M, 6C and 6K apart from the toner bottles 32Y, 32M, 32C and 32K. Accordingly, design flexibility is improved and it is possible to reduce the size of the printer.

Further, the toner providing openings (not shown) of the toner bottles 32Y, 32M, 32C and 32K, the toner transport means 40Y, 40M, 40C and 40K, and toner replenishing openings of the toner containers 54Y, 54M, 54C and 54K of the developing apparatuses 5Y, 5M, 5C and 5K are arranged at the side of one end of the intermediate transfer unit 15. Thus, it is possible to make the toner transport paths of the toner transport means 40Y, 40M, 40C and 40K minimum. Accordingly, it is possible to reduce the size of the printer and avoid blocking of toner while transporting the toner.

The structures of the toner transport apparatuses 40Y, 40M, 40C and 40K are the same. Thus, a description is given below of the toner transporting apparatus 40Y for transporting the Y toner.

Referring to FIG. 5, the toner transport apparatus 40Y generally includes: a drive motor 41Y; a drive gear 42Y, and a toner transport pipe 43Y. A coil (not shown) made of resin is provided inside the toner transport pipe 43Y. The drive gear 42Y engages the gear 37Y of the toner bottle 32Y. When the drive motor 41Y is driven, the bottle body 33Y, which is integrally rotated with the gear 37Y of the toner bottle 32Y, is rotated. When a concentration detecting sensor 56Y of the developing apparatus 5Y shown in FIG. 2 detects a deficiency in the toner concentration in the toner container 54Y, the drive motor 41Y is driven by a replenishment signal from a control part 57Y.

Referring to FIG. 5, a spiral developer guiding groove 38Y is formed on the inside wall of the bottle body 33Y. Hence, when the toner bottle 32Y is rotated, the toner therein is transported from the inner side of the bottle body 33Y toward the resin case 34Y, which is provided in the end portion of the toner bottle 32Y. Then, the toner inside the bottle body 33Y falls into a toner receiving part (not shown) of the toner transport apparatus 40Y via the toner providing opening (not shown) of the resin case 34Y. The toner receiving part is coupled to the toner transporting pipe 43Y. When the drive motor 41Y is driven, the bottle body 33Y is rotated, and simultaneously, the coil (not shown) inside the toner transport pipe 43Y is rotated. With the rotation of the coil, the toner having fallen into the toner receiving part is transported inside the toner transport pipe 43Y, and supplied to the toner replenishing opening (not shown) of the toner container 54Y of the developing apparatus 5Y. In the aforementioned manner, the toner concentration in the developing apparatus 5Y is adjusted.

Further, instead of providing the concentration detecting sensor 56Y, an optical sensor or a CCD camera, for example, for measuring the number of pixels of a reference image formed on the photo conductor 1Y may be provided, and toner container replenishment with toner may be performed on the basis of the measurement result.

A description is given below of a characterizing portion of this embodiment.

Figure 7:
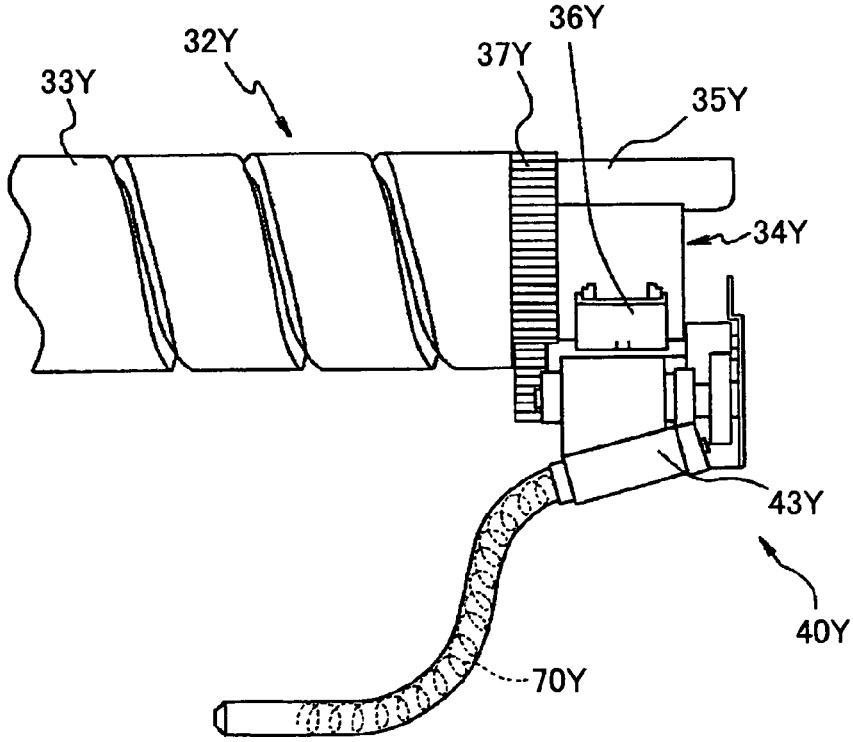
FIG. 7 is an enlarged schematic diagram showing a part of the Y toner transport apparatus.

FIG. 7 is an enlarged schematic diagram showing a part of the toner transport apparatus 40Y, serving as a Y powder transport apparatus. In this embodiment, a transportation coil 70Y, which serves as a powder transport member, is installed such that the transportation coil 70Y substantially contacts the inner wall of the toner transport pipe 43Y, which serves as a powder transport pipe. Further, it should be noted that, even in a portion where the toner transport pipe 43Y is distant from the transportation coil 70Y, the distance between the toner transport pipe 43Y and the transportation coil 70Y is approximately 0.1–0.2 mm at the maximum.

As mentioned above, by installing the transportation coil 70Y inside the toner transport pipe 43Y, a force to move the toner in the transport direction is applied to the toner. Hence, it is possible to prevent the toner from accumulating in the transport pipe 43Y. Accordingly, it is possible to avoid problems caused by sudden inflow of the Y toner accumulated in the transport pipe 43Y.

Further, since stress exerted to a coil shape by bending is small, even if the transport pipe 43Y is bent, it is possible for the transportation coil 70Y to be rotated. Because it is unnecessary to form the transport pipe 43Y into a linear shape, flexibility in layout is increased. Accordingly, it is possible to reduce the size of the developing apparatus (e.g., 5Y).

Instead of using the transportation coil 70Y, by using transport means having a screw-like shaft, there may be some cases where it is possible to transport toner in a transport path that is not linear. However, comparing the transport means having a shaft and the transportation coil 70Y, the transportation coil 70Y can be bent easier than the transport means. Hence, in a case where the transportation coil 70Y is used, a repulsive force against deformation at the time the transportation coil 70Y is rotated in a curved portion of the transport pipe 43Y becomes smaller. Thus, by using the transportation coil 70Y, it is possible to reduce sliding load with respect to the transport pipe 43Y, compared to the case where the transport means having the shaft is used.

Transport of the Y toner from the toner bottle 32Y is performed such that the Y toner is provided from the toner providing opening (not shown) to the toner transport apparatus every time the toner bottle 32Y makes one rotation.

Since transport is performed per rotation, the amount of the Y toner transported at a time is larger than that transported by the transportation coil 70Y. Since there is a space in the center portion of the transportation coil 70Y, irrespective of rotation of the transportation coil 70Y, the Y toner that exceeds the transporting capacity of the transportation coil 70Y flows through the space of the center portion of the transportation coil 70Y and reaches the developing apparatus 5Y. Therefore, there is a possibility that problems such as scumming may occur since a large amount of the Y toner is transported to the developing apparatus 5Y every time the toner bottle 32Y is rotated, and the toner concentration in the developing apparatus 5Y is rapidly increased.

Figure 8:
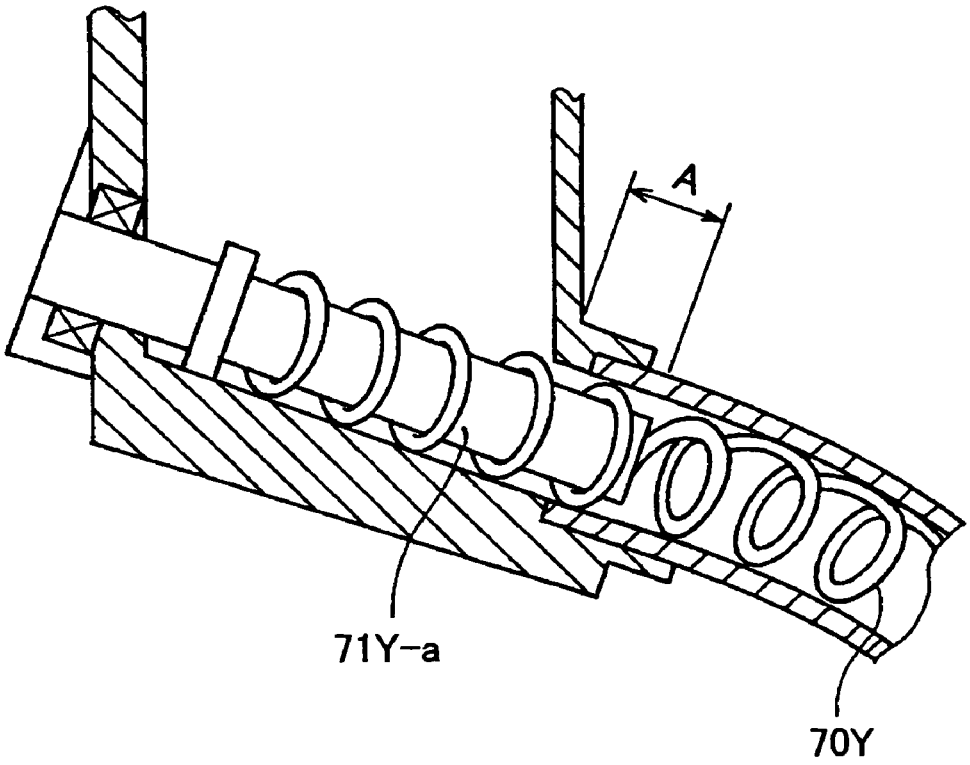
FIG. 8 is a schematic diagram showing a case where toner transportation amount control means is provided near the toner bottle.
Figure 9:
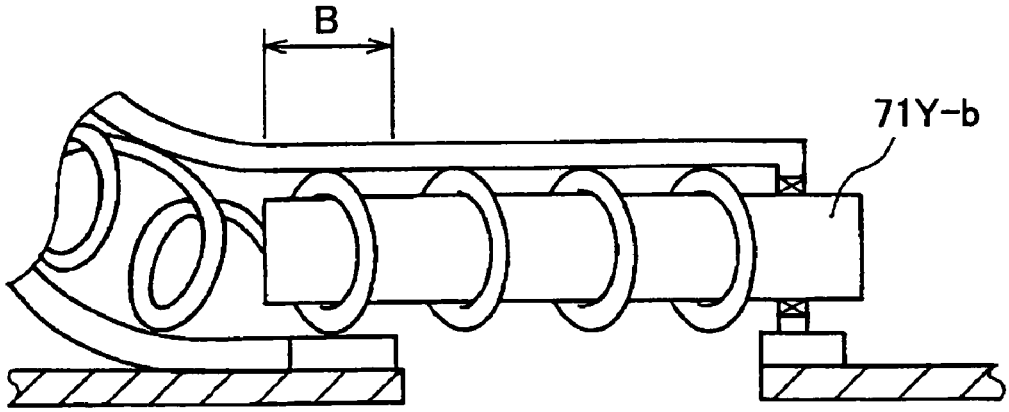
FIG. 9 is a schematic diagram showing a case where toner transportation amount control means is provided near the process cartridge.

On the other hand, FIGS. 8 and 9 show two embodiments in which the replenishment amount of, for example, the Y toner is regulated, and ability to regulate the amount of the Y toner that passes through the transport pipe 43Y is increased by using components in addition to the transport pipe 43Y, so that the Y toner is transported as the transportation coil 70Y is rotated.

FIG. 8 is a schematic diagram showing a case where a part that regulates the amount of Y toner that passes through the transport pipe 43Y is provided in the engaging portion (connection) between the transport pipe 43Y and the toner bottle 33Y. Within the engaging portion, a rotational shaft 71Y-*a* is bonded to the inner side of the transportation coil 70Y. It is assumed that a region A (see FIG. 8) indicates the region between: the downstream end of a portion of the toner bottle 33Y in the transport direction from which portion the Y toner is supplied; and a downstream end of the rotational shaft 71Y-*a* in the transport direction. Setting is made such that the transportation coil 70Y is wound at least one time (one pitch) in the region A. In the region A, the transportation coil 70Y contacts the inner side of the transport pipe 43Y, the rotational shaft 71Y-*a* contacts the inner side of the transportation coil 70Y, and the transportation coil 70Y is wound at least one time (one pitch). Hence, there is almost no space in the region A through which space the Y toner can pass through due to its own weight. Thus, irrespective of timings at which the Y toner is provided from the toner bottle 33Y, it is possible to dam the Y toner in the region A and make the Y toner pass through the region A only when the transportation coil 70Y is rotated. In the aforementioned manner, it is possible to stabilize the replenishment amount of the Y toner supplied to the developing apparatus 5Y.

FIG. 9 is a schematic diagram showing a case where a part that regulates the amount of the Y toner passing through the transport pipe 43Y is provided in the engaging part (connection) between the transport pipe 43Y and the process cartridge 6Y. In the engaging part, a rotational shaft 71Y-*b* is bonded to the inner side of the transportation coil 70Y. A region B indicates the region between the upstream end of the toner replenishing opening through which the Y toner is supplied to the process cartridge 6Y from the transport pipe 43Y and the upstream end of the rotational shaft 71Y-*b* in the transport direction. Setting is made such that the transportation coil 70Y is wound at least one time (one pitch) in the region B. In the region B, the transportation coil 70Y contacts the inner side of the transport pipe 43Y, the rotational shaft 71Y-*b* contacts the inner side of the transportation coil 70Y, and the transportation coil 70Y is wound at least one time(one pitch). Hence, there is almost no space in the region B through which space the Y toner can pass through the region B. Thus, irrespective of timings at which the Y toner is provided from the transport pipe 43Y, it is possible to dam the Y toner in the region B and make the Y toner pass through the region B only when the transportation coil 70Y is rotated. In the aforementioned manner, it is possible to stabilize the replenishment amount of the Y toner supplied to the developing apparatus 5Y.

In each of the embodiments shown in FIGS. 8 and 9, it is preferable that the transport pipe 43Y has a straight cylindrical shape and is not bent in the portion where the rotational shaft 71Y-*a* or 71Y-*b* is provided therein.

This is because, if the transportation coil 70Y having the rotational shaft 71Y-*a* (or 71Y-*b*) and the rotational shaft 71Y-*a* (or 71Y-*b*) are rotated in a bent portion (curved portion) of the transport pipe 43Y, repulsive forces of the transportation coil 70Y and the rotational shaft 71Y-*a* (or 71Y-*b*) against bending become large, and the sliding load with respect to the transport pipe 43Y is increased. Therefore, it is preferable that the transport pipe 43Y not be bent in the above-mentioned portion so as to avoid generation of the repulsive force against bending.

Toner transport means using a pump and airflow is known as toner transport means having a small sliding load with respect to toner transport path and capable of preventing a toner from flowing in the toner transport path having a curved portion. However, when such a pump is used, the size of the printer is increased since the pump has its own size. In addition, the number of components is increased, which results in an increase in costs. On the other hand, according to the present invention, it is possible to provide a smaller and less expensive printer including toner transport means having a small sliding load with respect to a toner transport path and capable of preventing toner from flowing.

In the printer, which is an image forming apparatus, the toner bottles, which serve as replenishing toner containers, may be configured to be placed from above the main body of the printer and be attachable to and detachable from the printer. In this case, since it is possible to set the toner bottles by placing the toner bottles above the printer, it is possible to easily understand and perform the replacing operation of the toner bottles. Accordingly, it is possible to improve ease of maintenance and replacement of imaging means.

Additionally, it is possible to reduce the size of the printer, which is an image forming apparatus, by locating a toner supplying portion inside the space formed by the side boards that support each component of the process cartridge by interposing the process cartridge therebetween. The toner supplying portion is a portion at which the toner is provided from the toner transport means to the developer container (e.g., 53Y) of the process cartridge (e.g., 6Y)

In the printers according to the above-mentioned embodiments, the transportation coil (e.g., 70Y) is provided in the transport pipe (e.g., 43Y) of the transport apparatus (e.g., 40Y) of each of the Y, M, C and K toners. Hence, a moving force in the transport direction is applied to the toner inside the transport pipe, and it is difficult for the toner to accumulate within the transport path. Thus, it is possible to avoid problems caused by accumulation of the toner. Further, since the transportation coil (e.g., 70Y) may be easily bent, the transportation coil can be rotated even if the transport pipe is bent. Thus, it is unnecessary to linearly transport the toner. Consequently, it is possible to increase flexibility in layout and reduce the size of the developing apparatus.

In addition, by using the transportation coil and providing a part having a higher ability of regulating the amount of toner that passes through the transport pipe than the other portions of the transportation coil, the amount of toner to be transported is determined only by the rotation of the transportation coil. Thus, since it is possible to prevent the toner from being supplied in high volume at a time, it is possible to stabilize replenishment of the toner.

Figure 10:
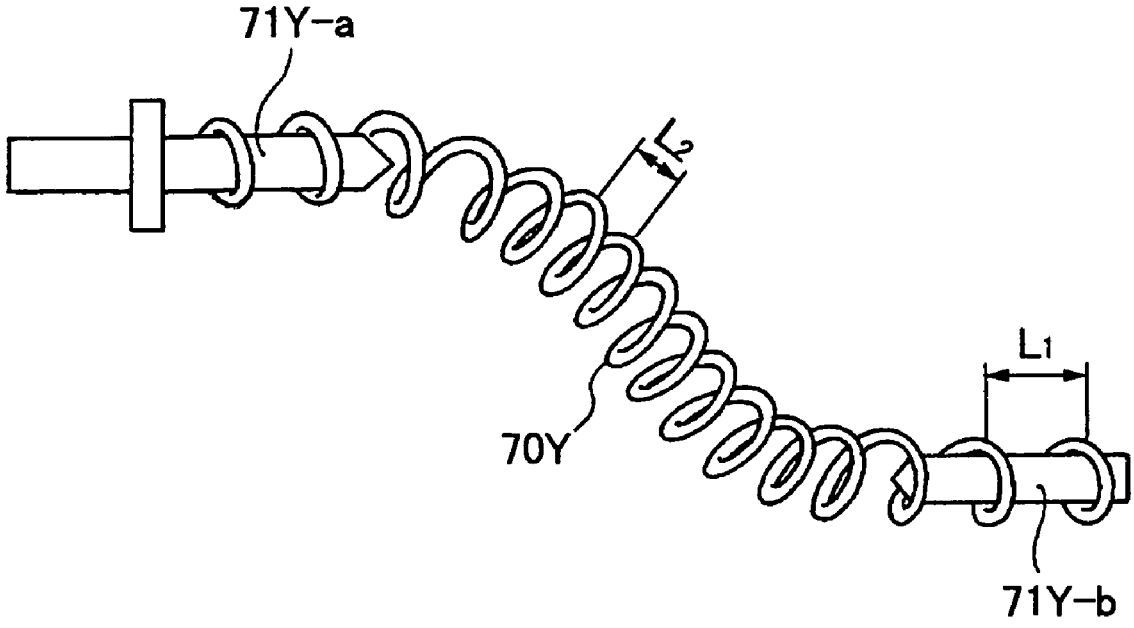
FIG. 10 is a schematic diagram for explaining a transport coil.

Further, in this embodiment, as shown in FIG. 10, setting may be made such that L1>L2 is satisfied, where L1 represents the length of one winding (one pitch) of the transportation coil in a straight (not bent) portion of the transport pipe, and L2 represents the length of one winding (one pitch) of the transportation coil inside a bent portion of the transport pipe. In the aforementioned manner, if the length of one pitch of the transportation coil is set to be short in the bent portion of the transport pipe, the transportation coil can be bent easier compared to the case where the length of one pitch is set to be longer, and a force exerted against the deformation at rotation is decreased. Hence, it is possible to reduce a sliding load between the transportation coil and the transport path.

According to the present invention, restrictions in the layout of the powder transport apparatus are decreased, and it is possible to increase flexibility in the layouts of other apparatuses. Simultaneously, it is possible to stabilize the transportation amount of powder.

In addition, with the use of the toner container (54Y) according to the present invention, it is possible to arrange the toner container (54Y) in a manner suitable to reduce the size of an image forming apparatus.

Further, with the use of the process cartridge (6Y, 6M, 6C, 6K) according to the present invention, it is possible to arrange the process cartridge (6Y, 6M, 6C, 6K) in a manner suitable to reduce the size of an image forming apparatus.

The present invention is not limited to the specifically disclosed embodiments, and variations and modifications may be made without departing from the scope of the present invention.

The present application is based on Japanese priority application No. 2003-187407 filed on Jun. 30, 2003, the entire contents of which are hereby incorporated by reference.

What is claimed is:

1. A powder transport apparatus, comprising:

a powder container containing a powder;

a powder transport pipe through which the powder is transported from the powder container to a transport destination located below the powder container;

a powder transport member that is provided in the powder transport pipe and exerts, when the powder transport member is moved, a force on the powder such that the powder is moved downstream in a transport direction along which the powder is to be transported; and a part that regulates an amount of the powder transported through the powder transport pipe, said part being provided in the powder transport pipe, wherein the part that regulates the amount of powder is disposed within and contacting an interior of the powder transport member, and a gap between the powder transport pipe and the powder transport member is at most about 0.2 mm.

2. The powder transport apparatus as claimed in claim 1, wherein the powder transport member is a coil, and the part that regulates the amount of the powder transported through the powder transport pipe is structured by providing a rotational shaft that contacts an inner side of the coil in a connection where the powder transport pipe is connected to the powder container.

3. The powder transport apparatus as claimed in claim 2, wherein an end portion of the rotational shaft projects downstream in the transport direction from an opening of the powder container through which opening the powder is provided, and the coil is wound at least one time around the end portion of the rotational shaft projecting from the opening.

4. The powder transport apparatus as claimed in claim 3, wherein the powder transport pipe has a cylindrical shape and is not bent in a portion where the rotational shaft is provided therein.

5. The powder transport apparatus as claimed in claim 2, wherein the powder transport pipe has a cylindrical shape and is not bent in a portion where the rotational shaft is provided therein.

6. The powder transport apparatus as claimed in claim 2, wherein a pitch of the coil in a bent portion of the powder transport pipe is shorter than a pitch of the coil in an unbent portion of the powder transport pipe.

7. The powder transport apparatus as claimed in claim 1, wherein the powder transport member is a coil, and the part that regulates the amount of the powder transported through the powder transport pipe is structured by providing a rotational shaft that contacts an inner side of the coil in a connection where the powder transport pipe is connected to the transport destination.

8. The powder transport apparatus as claimed in claim 7, wherein an end portion of the rotational shaft is projected upstream in the transport direction beyond an opening of the powder transport pipe from which opening the powder is provided to the transport destination, and the coil is wound at least one time around the end portion of the rotational shaft projecting upstream beyond the opening.

9. The powder transport apparatus as claimed in claim 8, wherein the powder transport pipe has a cylindrical shape and is not bent in a portion where the rotational shaft is provided therein.

10. The powder transport apparatus as claimed in claim 7, wherein the powder transport pipe has a cylindrical shape and is not bent in a portion where the rotational shaft is provided therein.

11. The powder transport apparatus as claimed in claim 7, wherein a pitch of the coil in a bent portion of the powder transport pipe is shorter than a pitch of the coil in an unbent portion of the powder transport pipe.

12. An image forming apparatus, comprising:

a toner image forming part forming a toner image by using toner; and a toner transport apparatus transporting the toner from a toner container to the toner image forming part, said toner transport apparatus including the toner container containing the toner;

a toner transport pipe through which the toner is transported from the toner container to a transport destination located below the toner container;

a toner transport member that is provided in the toner transport pipe and exerts, when the toner transport member is moved, a force on the toner such that the toner is moved downstream in a transport direction along which the toner is to be transported; and a part that regulates an amount of the toner transported through the toner transport pipe, said part being provided in the toner transport pipe, wherein the part that regulates the amount of toner is disposed within and contacting an interior of the toner transport member, and a gap between the toner transport pipe and the toner transport member is at most about 0.2 mm.

13. The image forming apparatus as claimed in claim 12, wherein the toner transport member is a coil, and the part that regulates the amount of the toner transported through the toner transport pipe is structured by providing a rotational shaft that contacts an inner side of the coil in a connection where the toner transport pipe is connected to the toner container.

14. The image forming apparatus as claimed in claim 13, wherein an end portion of the rotational shaft projects downstream in the transport direction from an opening of the toner container through which opening the toner is provided, and the coil is wound at least one time around the end portion of the rotational shaft projecting from the opening.

15. The image forming apparatus as claimed in claim 14, wherein the toner transport pipe has a cylindrical shape and is not bent in a portion where the rotational shaft is provided therein.

16. The image forming apparatus as claimed in claim 13, wherein the toner transport pipe has a cylindrical shape and is not bent in a portion where the rotational shaft is provided therein.

17. The image forming apparatus as claimed in claim 12, wherein the toner transport member is a coil, and the part that regulates the amount of the toner transported through the toner transport pipe is structured by providing a rotational shaft that contacts an inner side of the coil in a connection where the toner transport pipe is connected to the transport destination.

18. The image forming apparatus as claimed in claim 17, wherein an end portion of the rotational shaft is projected upstream in the transport direction beyond an opening of the toner transport pipe from which opening the toner is provided to the transport destination, and the coil is wound at least one time around the end portion of the rotational shaft projecting upstream beyond the opening.

19. The image forming apparatus as claimed in claim 18, wherein the toner transport pipe has a cylindrical shape and is not bent in a portion where the rotational shaft is provided therein.

20. The image forming apparatus as claimed in claim 17, wherein the toner transport pipe has a cylindrical shape and is not bent in a portion where the rotational shaft is provided therein.

21. The image forming apparatus as claimed in claim 12, wherein a pitch of the coil in a bent portion of the toner transport pipe is shorter than a pitch of the coil in an unbent portion of the toner transport pipe.

22. The image forming apparatus as claimed in claim 12, wherein the toner image forming part is an image forming unit including a latent image carrier carrying a latent image thereon and a developing part developing the latent image on the latent image carrier, the image forming unit is attachable to and detachable from the image forming apparatus, and the toner container is attachable to and detachable from the image forming apparatus separately from the image forming unit.

23. A process cartridge configured to be used in an image forming apparatus including:

a toner image forming part forming a toner image by using toner; and a toner transport apparatus transporting the toner from a toner container to the toner image forming part, said toner transport apparatus including the toner container containing the toner;

a toner transport pipe through which the toner is transported from the toner container to a transport destination located below the toner container;

a toner transport member that is provided in the toner transport pipe and exerts, when the toner transport member is moved, a force on the toner such that the toner is moved downstream in a transport direction along which the toner is to be transported; and a part that regulates an amount of the toner transported through the toner transport pipe, said part being provided in the toner transport pipe, wherein the part that regulates the amount of toner is disposed within and contacting an interior of the toner transport member, and a gap between the toner transport pipe and the toner transport member is at most about 0.2 mm, and wherein the toner image forming part is an image forming unit including a latent image carrier carrying a latent image thereon and a developing part developing the latent image on the latent image carrier, the image forming unit is attachable to and detachable from the image forming apparatus, and the toner container is attachable to and detachable from the image forming apparatus separately from the image forming unit.

24. A process cartridge configured to be used in an image forming apparatus including:

a toner image forming part forming a toner image by using toner; and a toner transport apparatus transporting the toner from a toner container to the toner image forming part, said toner transport apparatus including the toner container containing the toner;

a toner transport pipe through which the toner is transported from the toner container to a transport destination located below the toner container;

a toner transport member that is provided in the toner transport pipe and exerts, when the toner transport member is moved, a force on the toner such that the toner is moved downstream in a transport direction along which the toner is to be transported; and a part that regulates an amount of the toner transported through the toner transport pipe, said part being provided in the toner transport pipe, wherein the part that regulates the amount of toner is disposed within and contacting an interior of the toner transport member, and a gap between the toner transport pipe and the toner transport member is at most about 0.2 mm, and wherein the toner image forming part is an image forming unit includes an image carrier carrying an electrostatic latent image thereon, a charging unit charging the image carrier, a developing unit developing the electrostatic latent image on the image carrier into a toner image by carrying a developer on a developer carrier and transporting the developer to a developing region facing the image carrier, and a cleaning unit removing residual toner remaining on the image carrier after the developed toner image is transferred to a transfer medium, the image forming unit is attachable to and detachable from the image forming apparatus, the toner container is attachable to and detachable from the image forming apparatus separately from the image forming unit, the process cartridge integrally supporting one or more units selected from the group consisting of the image carrier, the developing unit, the charging unit, and the cleaning unit, said units including at least the developing unit; and the process cartridge is attachable to and detachable from the image forming apparatus.

* * * * *